United States Patent [19]

Shemitz

[11] 4,233,656

[45] Nov. 11, 1980

[54] ASSEMBLABLE LAMP SHADE AND STRUCTURES

[75] Inventor: Norman S. Shemitz, Milford, Conn.

[73] Assignee: Shemsafe Incorporated, Milford, Conn.

[21] Appl. No.: 950,592

[22] Filed: Oct. 12, 1978

[51] Int. Cl.[3] ..... F21V 1/06; F21V 1/12

[52] U.S. Cl. ..... 362/352; 362/358; 362/360; 362/367

[58] Field of Search ..... 362/352, 353, 358, 360, 362/806-809, 367; D48/3, 15, 23 R; 428/7-9, 12; 46/21, 26, 31, 39

[56] References Cited

U.S. PATENT DOCUMENTS

| | | | |
|---|---|---|---|
| 956,632 | 5/1910 | Finch | 46/26 |
| 2,731,748 | 1/1956 | Polay | 40/155 |
| 3,010,246 | 11/1961 | England | 46/1 |
| 3,120,078 | 2/1964 | Bessinger | 46/21 |
| 3,271,895 | 9/1966 | Sorenson | 46/31 |
| 3,866,366 | 2/1975 | Fuller | 52/81 |
| 4,035,633 | 7/1977 | Grumbeck | 362/351 |
| 4,044,448 | 8/1977 | Watanabe | 29/433 |
| 4,079,245 | 3/1978 | Baker | 362/358 |

OTHER PUBLICATIONS

Shemsafe, Inc., *Ultralights,* 1977, (Brochure).

*Primary Examiner*—J. V. Truhe
*Assistant Examiner*—Shelley Wade
*Attorney, Agent, or Firm*—Larson, Taylor and Hinds

[57] ABSTRACT

In a lamp shade of the type comprising a plurality of panels, preferably glass panels, held together by a support system having stiff collars at the corners of the panels and connecting members connecting together groups of said collars, some of the connecting members are formed as elastic members, as a result of which the support system holds the panels together into a lamp shade of a desired polyhedral configuration under the tension of the elastic members. The support system may be preassembled and compacted to a small size for storage, packing or shipping in such state together with a stacked pack of the panels to be used therewith, permitting final assembly of the panels to the support system by the ultimate consumer in a very short time without the need for tools. There results a decrease in space and fragility during storage, shipping and handling, with attendant cost savings.

19 Claims, 4 Drawing Figures

ASSEMBLABLE LAMP SHADE AND STRUCTURES

TECHNICAL FIELD

The present invention relates in general to lamp shades, and in particular to readily assemblable and disassemblable lamp shades comprising a plurality of separate panels usually made of glass or the like. Since aesthetics generally dictate the use of glass panels, the invention will be described with particular reference to such lamp shades having glass panels.

BACKGROUND OF THE INVENTION

The present invention resides in an improvement to lamp shades having separate panels such as glass or the like and generally comprising a plurality of such panels connected together by a support system in a predetermined polyhedral configuration. In prior art lamp shades of this type, which are exemplified by the devices disclosed in U.S. Pat. No. 4,079,245, and U.S. Pat. Nos. De. 246,267; 246,268; 246,269; 246,270 and 246,742; the support system has consisted of a frame formed by rigid collars extending about the corners of the glass panels, and stiff arms, usually made of metallic wire having a hook portion at either end thereof for connecting groups of adjacent collars and a body portion extending between the hook portions for interconnecting the spaced apart collars or groups of collars.

As a result of their being aesthetically pleasing, lamp shades having the known wire arm frame support systems have had a fair degree of commercial acceptance. However, they nonetheless suffer from a number of disadvantages which limit their utility and substantially increase their cost. A principal disadvantage inheres in the fact that lamp shades employing frames with stiff wire arms are not readily assemblable, and hence are assembled as a part of the manufacturing procedure and are marketed only in completely assembled form. Since these lamp shades, like lamp shades of any type, tend to be relatively bulky, there are increased inventory and freight costs associated with storing and shipping assembled lamp shades. Further, since these prior lamp shades having glass panels and wire arm support systems are relatively fragile, they are particularly prone to damage during shipping and handling, even with specially adapted frames such as that disclosed in the aforementioned U.S. Pat. No. 4,079,245. Consequently lamp shades with such wire arm frames must necessarily entail increased transportation costs, and all too often entail increased consumer dissatisfaction with damaged goods.

Another disadvantage of conventional wire arm frames for glass panel lamp shades is that since such shades are difficult to disassemble, it is difficult to effectuate repairs. Hence even when only a single glass panel, or only a relatively few panels, are broken, either in transport or in use, the shade cannot realistically be repaired without replacing the entire shade.

A further disadvantage of wire arm frames for panel lamp shades of the present type, especially when the panels are made of glass, is that such frames are impractical unless the wire arms are specially configured to prevent damage to the glass panels during shipping and handling of the shades. Such arms are relatively difficult to fabricate and must be manufactured to relatively close tolerances in order to be effective.

It is to be noted that despite the above noted disadvantages of wire arm frame support systems, they have nonetheless been thought necessary heretofore by those in the art of glass panel shades in order to provide an aesthetically pleasing lamp shade having the requisite strength and rigidity for supporting the relatively heavy glass panels in the desired polyhedral configuration.

SUMMARY OF INVENTION

It is the purpose of the present invention to provide a lamp shade of the type comprising separate panels, usually made of glass, held together by a support system, wherein the above described and other disadvantages of such panel lamp shades are overcome.

This purpose of the present invention is achieved by providing a support system comprising essentially stiff collars and elastic bands which are capable of being shipped unconnected to each other or assembled as a unit separate from the individual panels. In either case the panels may then be shipped in a simple compact stacked pack unconnected to the support system, wherein the support system and the glass panels can then be easily assembled, e.g. even by the end user, in a matter of minutes, without tools, to provide the lamp shade of the desired polyhedral configuration.

Consequently, as compared to a prior assembled wire frame lamp shade, with a lamp shade made in accordance with the present invention, the shipped package can be drastically reduced in size, the glass panels can be packaged more securely against breakage, and even if a single panel does break, the customer can be sent a single replacement panel, i.e. it is not necessary to replace the entire lamp shade; and as an ultimate result, the overall costs of such lamp shades to the customer can be considerably reduced.

In accordance with a preferred embodiment of the present invention, the support system, in combination with panels on an assembled lamp shade, comprises conventional rigid collars at the corners of the panels, but in lieu of the prior wire arms, elastic members are used to interconnect the collars together such that a group of adjacent collars on juxtaposed panels are connected together at the proximate ends by said elastic member, which at its other end connects together another collar or another group of adjacent collars at their proximate ends and wherein the elastic member is stretched between the two said groups of collars such that the collars of both groups are releasably held in place against their respective panels. Such a system of collars, held together by said elastic members, are located throughout the spaces between adjacent panels, so that in the overall lamp shade, all of the panels are releasably held under tension in the desired polyhedral configuration.

In accordance with another feature of the invention, the entire support system with all collars and elastic support members may be preassembled as a unit, separate from the panels, and then be compacted down to a very small package, e.g. for storage and/or shipping, separate from the panels themselves, which then may be stored or shipped in a stacked pack; whereupon the panels can be assembled to the support system in a very short time, without tools, to provide a finished lamp shade.

The objects and advantages of the present invention will become more apparent from the detailed description which follows, of a preferred embodiment of the present invention.

BRIEF DESCRIPTION OF THE DRAWINGS

The present invention will now be described with reference to a preferred embodiment which will be described in detail with reference to the accompanying drawings, wherein.

DETAILED DESCRIPTION

Referring to the figures, like elements are represented by like numerals, throughout the several views.

Figure 1:
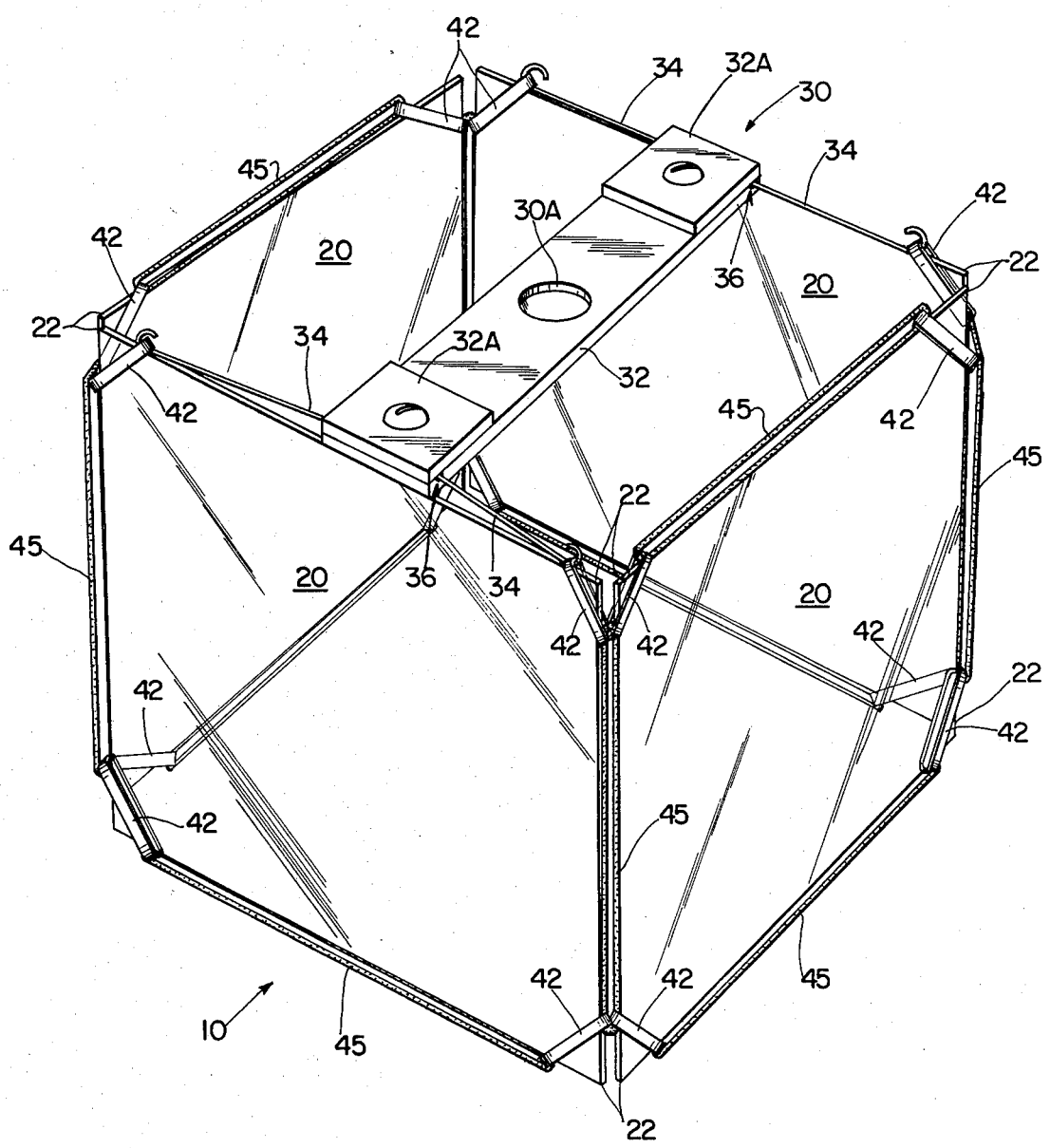
FIG. 1 is a perspective view looking from above of a lamp shade, the panels of which shade are connected in accordance with features of the present invention.
Figure 2:
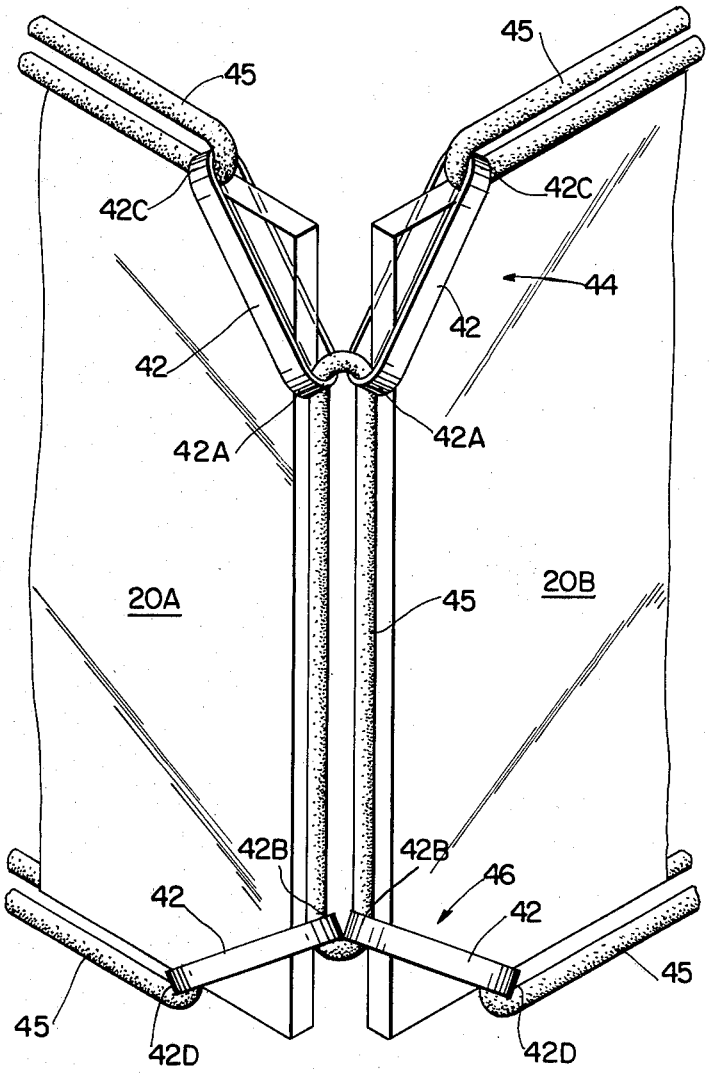
FIG. 2 is an enlarged detail view of a portion of the lamp shade illustrated in FIG. 1.

Referring to FIGS. 1 and 2, a lamp shade is illustrated which is constructed in accordance with the present invention. The shade, which is generally denoted 10, basically comprises a plurality of conventional panels 20, which preferably are made of glass for aesthetic reasons; a support system 40 (See FIG. 4) for supporting panels 20 in a predetermined polyhedral configuration, as shown; and a horizontal support 30 for a light fixture (not shown), to be supported through opening 30A.

Support system 40 comprises a plurality of collars 42 which engage panels 20 at the corners 22 thereof, and a plurality of elastomeric members 45 connecting collars 42 together in the manner to be described in more detail hereinbelow.

Each collar 42 preferably has the configuration of a flattened annulus so as to extend, as shown, diagonally around the corresponding corner 22, as is well known in the art.

When shade 10 is assembled, pairs of panels 20, such as, for example, panels 20A and 20B shown in FIG. 2, are disposed in juxtaposed, spaced-apart relationship. Referring in particular to the space between panels 20A and 20B, as best shown in FIG. 2, the collars 42 engaging the juxtaposed panel edges are disposed so as to define two spaced-apart groups of collars, said groups generally denoted 44 and 46, respectively, each group having a pair of relatively opposed, adjacent collars 42.

The collars 42 of group 44 are connected together at their proximte ends 42A by the tensioned elastic member 45 which loops around said proximate ends 42A and then extends, under tension, along the space between panels 20A and 20B, thereby pulling said collars of group 44 to hold them in their proper position on the upper corners of panels 20A and 20B; and said elastic member 45 extends to its opposite end where it similarly loops around the proximate ends 42B of the collars 42 of group 46, similarly pulling those collars to hold them in their proper position on the lower corners of panels 20A and 20B.

As is evident in FIG. 2, each of the four collars 42, at their remote ends 42C opposite said proximate ends 42A and 42D opposite 42B, then cooperate with a further elastic member, in some cases with other collars and in some cases without a further collar. The system thus continues until it is completed with all panels thus securely held by collars at all operative corners facing adjacent panels, with elastic members extending between the different collars or groups of collars, to provide the desired polyhedral configuration with the elastic members 45 under tension.

Figure 3:
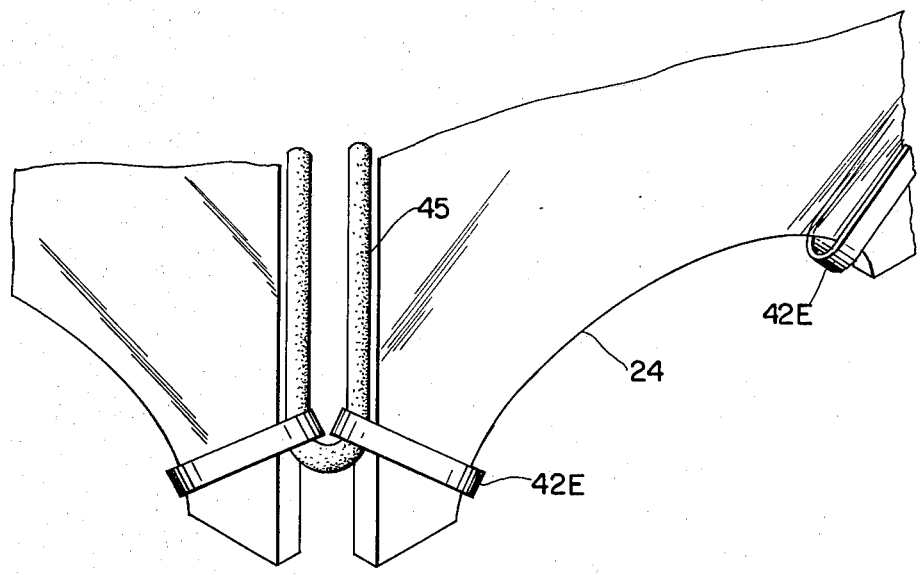
FIG. 3 is an enlarged detail view of the lower part of a lamp shade similar to FIGS. 1 and 2 but with a modified lower construction, and made in accordance with the present invention.

Generally all of the collars 42 on a panel 20 are connected by elastic members 45 to collars of other groups. However, as shown in FIG. 3, no elastic member 45 need be used between adjacent collars which engage a curved, non-juxtaposed panel edge, such as collars 42E engaging curved panel edge 24 shown in FIG. 3. A complete lamp shade with such lower corners is shown in the above noted U.S. Pat. No. De. 246,270. In addition, light fixture support 30 is preferably mounted, as shown in FIG. 1, to the rest of shade 10 by wire connectors 34 which extend between the collars 42 engaging the top edges of two opposed panels 20.

As shown, light fixture support 30 advantageously may comprise a flat bar-like member 32 having slots 36 in the upper surface thereof which cooperate with screwed down clamp pieces 32A to releasably clamp connectors 34 between the member 32 and the pieces 32A.

Figure 4:
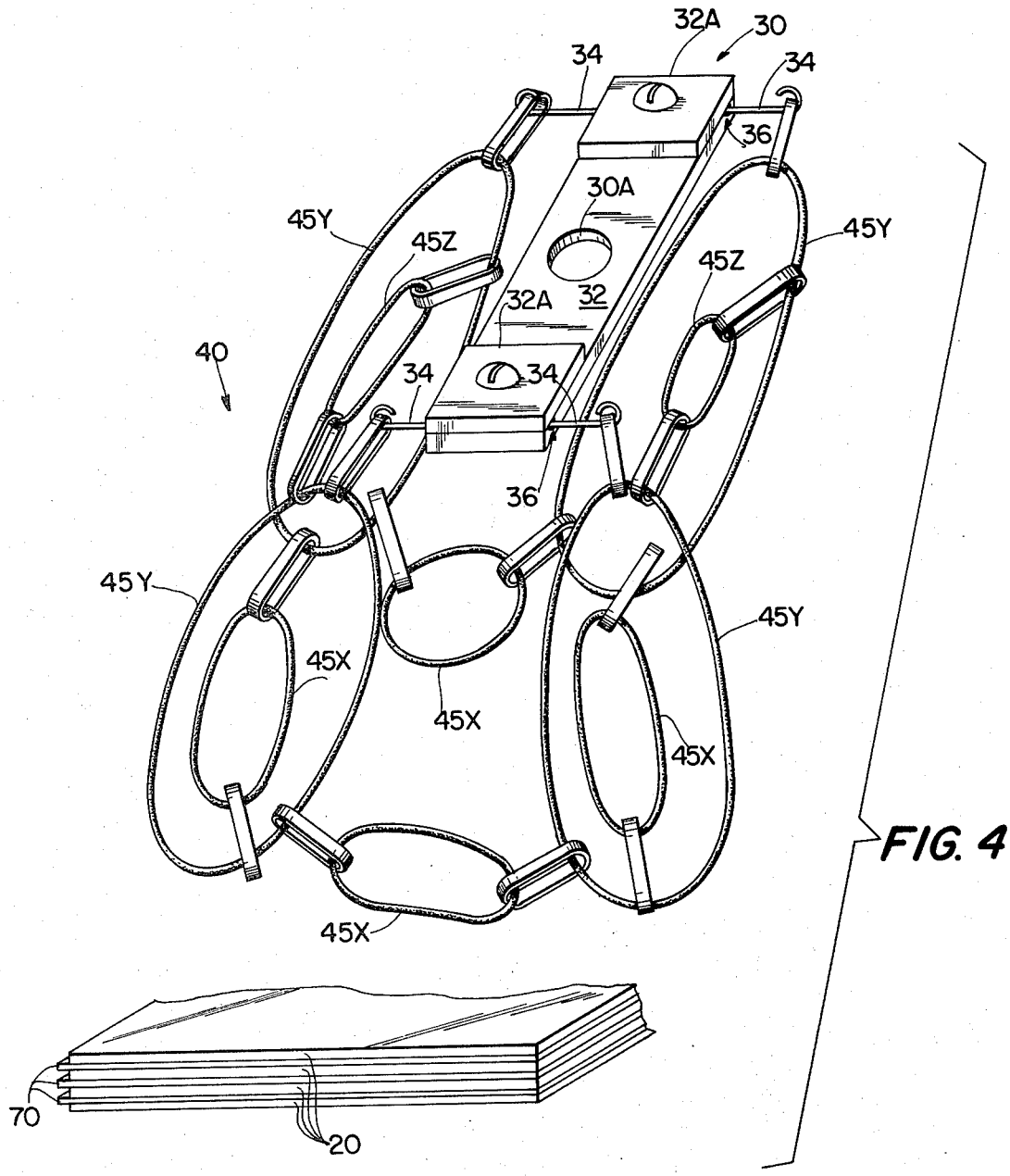
FIG. 4 is a pictorial view of the lamp shade of FIG. 1 in a disassembled form adapted for shipping.

The support system constructed in accordance with the present invention, such as support system 40 described hereinabove, may be completely preassembled independently of the panels. Further, a lamp shade may be readily assembled and disassembled in a matter of minutes, without the need for any tools, using a preassembled support system 40 simply by selectively stretching the various elastic members 45 so as to, respectively, fit the collars 42 over the corresponding panel corners 22 of a first panel 20 comprising the lamp shade, and then attaching an adjacent panel, and thereafter working around the lamp shade until reaching the first panel. In addition, although the support system of the present invention provides a relatively rigid lamp shade when the panels are mounted therein, the support system is collapsible into a compact mass when the panels are removed therefrom. As a consequence, a lamp shade constructed in accordance with the present invention may be stored, shipped and marketed in a disassembled, highly compact form, as shown in FIG. 4, wherein panels 20 are stacked with sheets of shock-absorbing material, generally denoted 70, disposed therebetween and support system 40 is collapsed into a relatively small configuration, which minimizes breakage, as well as freight and inventory costs. To avoid confusion, however, it will be noted that in FIG. 4 the elements 34 are drawn shorter than they actually are in FIG. 1 and only portions of the plate 20 are shown. To assist visualizing the compacted support system 40 of FIG. 4, the four elastic members 45 which would extend along the bottoms of panels 20 are labeled 45X, the four which extend vertically between panels 20 are labeled 45Y, and the two which extend along the top of panels 20 unconnected to support 30, are labeled 45Z. Of course the collars and elastomeric members need not be completely interconnected in the form as shipped and marketed, but rather, thay can be disconnected as shipped and marketed and then assembled in accordance with instructions provided to the person who ultimately assembles the lampshade. Moreover, damaged panels may be readily replaced without the need for special tools or the need to disassemble the support system.

Although, for succinctness, the invention has been described only with respect to one or two shapes of lamp shades, it should be apparent that the invention is applicable to numerous other configurations. For example, the support system of the present invention may be constructed for any of the lamp shades shown in the design patents referred to above in this application or as shown in models 101–115 and 117–125 in a brochure distributed publicly by the Shem Safe Inc. Company of Milford, Connecticut. In the more complex shapes, it can be seen that the panels therein are generally formed into groups, defining a "group" as all panels arranged around a common axis wherein the elastic members 45 tend to pull those panels of the group against each other to maintain the shape of that group. Often the groups comprise panels, all arranged at a common height (i.e. centered about a vertical axis). Three such groups or "tiers" are shown in the configuration illustrated in U.S. Pat. No. De. 267,270. In other cases, such as models 114 and 117 in the above noted Shem Safe brochure, the groups may be centered about a horizontal axis and the groups then may essentially pull against each other to form the finished lamp shade. To assemble the more complex shaped lamp shades, one would start with a panel and work around the panels of that group as described above with respect to FIG. 1, and then similarly start on and finish assembling panels of an adjacent group, and so on until the lamp shade is fully assembled.

The collars 42 should be stiff and rigid, for example hard metal (even a paperclip will be operable); and the elastic members 45 can be of any elastic material so long as it is of the required strength and applies the proper tension. While a simple rubber band would be operable, it is preferable, for purposes of strength, to utilize a fabric type elastic cord which may be manufactured as a closed loop (which is illustrated in the figures herein) or is manufactured by clipping a sufficient length of an elongated cord and then closing such length on itself and securing the same into the form of a loop by a suitable clasp. The collars are generally formed from stiff flat wire material, preferably brass for aesthetic reasons, and are cut and bent into shape with the ends thereof close but not welded, so that the loops of the elastic members can easily be inserted into the collars.

In the specification, the term "group of collars" refers to all of the collars grasped at a given end of a stretched elastic member. It is to be understood, of course, that the group may consist of a single collar, as may occur for example along an edge of the lamp shade, such as at the upper and lower portions of FIG. 2 were the ends 42C or 42D of the collars 42 are grasped by single elastic members 45. It will also be noted that the advantages of the present invention of providing a compact assemblable and disassemblable lamp shade with a highly compactable support system holding all of the panels together under tension may also be achieved even if not all of the connecting members are of the elastomeric type. For example, there was described earlier the arrangement of FIG. 1 wherein at each end of the support bar 32 rigid members 34 were connected to adjacent collars 42. Also, another arrangement could be visualized wherein all of the connecting members in a given plane, such as in the plane of the top of the panels or in the plane of the bottom of the panels or possibly in both planes could be of the conventional rigid wire connectors. In this case so long as the vertical connecting members comprised elastic members 45, the support system could still be preassembled, highly compacted, although clearly not as compacted as if all members were of the elastic type, and then assembled to the panels in the manner as described. When utilizing a combination of metal connecting members and elastic connecting members, it is important, however, that there be a sufficient number of elastic members associated with each panel to assure that the system would be held on the panels and hold the lamp shade in its desired polyhedral configuration under tension.

Although the invention has been described in considerable detail with respect to preferred embodiments thereof, it will be apparent that the invention is capable of numerous modifications and variations apparent to those skilled in the art, without departing from the spirit and scope of the invention.

I claim:

1. An improved support system for a lamp shade of the type having a plurality of panels connected together by the support system in a predetermined polyhedral configuration, each of the panels defining a plurality of corners; comprising, a plurality of collars, each collar being adapted to extend around a corresponding one of the panel corners, elastic connecting members connecting at least some of the collars together such that groups of opposing, adjacent collars on juxtaposed panels are connected together at their proximate ends by a said elastic member, and at least some of the said groups of collars are connected to other groups of collars which are spaced from the first group, by tensioned elastic members stretched between the said groups of collars, such that all of the collars are capable of being releaseably held in place on their respective panels, to releaseably hold all of the panels under the tension of the elastic members in the predetermined polyhedral configuration.

2. The support system of claim 1, wherein said collars are each in the form of a flattened member formed as a closed loop of flattened metallic wire.

3. The support system of claim 1, wherein said elastic members are formed as continuous closed loops.

4. The support system of claim 1, in combination with a pack of panels adapted to cooperate with the support system to form the lamp shade of the said predetermined polyhedral configuration.

5. A method of assembling a lamp shade from the combination of claim 4, comprising taking a first panel, placing thereon all of the collars of the support system adapted for that panel, including stretching the respective elastic members around the edges thereof, taking an adjacent panel and placing thereon the collars which are opposed adjacent collars to those of the first panel, placing the remaining collars on that second panel, including stretching the respective elastomeric members around the edges thereof and continuing to take adjacent panels and attach its respective collars thereto.

6. An improved lamp shade, the lamp shade comprising a plurality of panels connected together by a support system in a predetermined polyhedral configuration, each of the panels defining a plurality of corners, and the support system comprising a plurality of collars, each collar being adapted to extend around a corresponding one of the panel corners, elastic connecting members connecting at least some of the collars together such that groups of opposing adjacent collars on juxtaposed panels are connected together at their proximate ends by a said elastic member and at least some of the said groups of collars are connected to other groups of collars spaced from the first said group by tensioned elastic members stretched between the said groups of collars, such that all of the collars are releaseably held in place on their respective panels, and all of the panels are releaseably held under the tension of the elastic members in the predetermined polyhedral configuration.

7. The improved lamp shade of claim 6, wherein at least some of the vertically extending panel edges facing an adjacent panel edge includes thereat an elastic member.

8. The improved lamp shade of claim 6, wherein said collars are each in the form of a flattened annulus formed as a closed loop of flattened metallic wire.

9. The improved lamp shade of claim 6, wherein said elastic members are formed as continuous closed loops.

10. The improved lamp shade of claim 6, wherein all groups of collars at a first intersection of panel corners are connected to at least one other group of collars at another intersection of panel corners by a said elastic member.

11. The invention of claim 1 or claim 6, said collars being a stiff material in the form of an elongated flat member formed as a closed loop with the ends of the elongated member close together to essentially close the loop but not connected together.

12. The invention of claim 11, said elastic members being closed loops insertable into the collars between said close ends.

13. A method of assembling a lamp shade of the type having a plurality of panels connected together by a support system comprising collars which fit onto corners of the panels and elastic members extending along the edges of the panels and interconnecting the collars together to releasably hold all of the panels under the tension of the elastic members in a predetermined polyhedral configuration, comprising: taking a first panel, placing thereon all of the collars for the corners of that panel, stretching the respective elastic members connected to those collars along the edges of that panel so as to exert a force urging said collars onto that panel, taking an adjacent panel and placing collars on the corners thereof adjacent to the first said panel with said collars of the second panel also being engaged with elastic members lying along edges of the first panel which abut an edge of the second panel, placing collars onto the remaining corners of the second panel which are not adjacent to the first panel and interconnecting the collars of the second panel by elastic members which act to urge the collars of the second panel onto the second panel, and repeating the steps associated with the second panel for subsequent successive adjacent panels until the predetermined polyhedral configuration is formed.

14. An improved support system for a structure having a plurality of panels connected together by the support system in a predetermined polyhedral configuration, each of the panels defining a plurality of corners; comprising, a plurality of collars, each collar being adapted to extend around a corresponding one of the panel corners, elastic connecting members connecting at least some of the collars together such that groups of opposing, adjacent collars on juxtaposed panels are connected together at their proximate ends by a said elastic member, and at least some of the said groups of collars are connected to other groups of collars which are spaced from the first said group by tensioned elastic members stretched between the said groups of collars, such that all of the collars are capable of being releaseably held in place on their respective panels, to releaseably hold all of the panels under the tension of the elastic members in the predetermined polyhedral configuration.

15. A structure comprising a plurality of panels connected together by a support system in a predetermined polyhedral configuration, each of the panels defining a plurality of corners, and the support system comprising a plurality of collars, each collar being adapted to extend around a corresponding one of the panel corners, elastic connecting members connecting at least some of the collars together such that groups of opposing adjacent collars on juxtaposed panels are connected together at their proximate ends by a said elastic member and at least some of the said groups of collars are connected to other groups of collars spaced from the first said group by tensioned elastic members stretched between the said groups of collars, such that all of the collars are releaseably held in place on their respective panels, and all of the panels are releaseably held under the tension of the elastic members in the predetermined polyhedral configuration.

16. The invention of claim 14 or claim 15, wherein said collars are each in the form of a flattened member formed as a closed loop of flattened metallic wire.

17. The invention of claim 16, wherein the abutting ends of the closed loop of the collar are not connected together.

18. The invention of claim 17, said elastic members being closed loops insertable into the collars between said close but not connected ends.

19. A method of assembling a structure having a plurality of panels connected together by a support system comprising collars which fit onto corners of the panels and elastic members extending along the edges of the panels and interconnecting the collars together to releaseably hold all of the panels under the tension of the elastic members in a predetermined polyhedral configuration comprising: taking a first panel, placing thereon all of the collars for the corners of that panel, stretching the respective elastic members connected to those collars along the edges of that panel so as to exert a force urging said collars onto that panel, taking an adjacent panel and placing collars on the corners thereof adjacent to the first said panel with said collars of the second panel also being engaged with elastic members lying along edges of the first panel which abuts an edge of the second panel, placing collars onto the remaining corners of the second panel which are not adjacent to the first panel and interconnecting the collars of the second panel by elastic members which act to urge the collars of the second panel onto the second panel, and repeating the steps associated with the second panel for subsequent successive adjacent panels until the predetermined polyhedral configuration is formed.

* * * * *